United States Patent [19]

Turner

[11] 3,952,531

[45] Apr. 27, 1976

[54] CRYOGENIC STORAGE TANKS

[75] Inventor: Frederick Henry Turner, Reading, England

[73] Assignee: Simon-Carves Limited, Stockport, England

[22] Filed: Jan. 2, 1974

[21] Appl. No.: 429,842

[30] Foreign Application Priority Data

Jan. 31, 1973 United Kingdom ..... 4923/73

[52] U.S. Cl. ..... 62/45; 61/.5; 62/238; 62/260; 165/45; 220/9 LG; 220/9 B

[51] Int. Cl.[2] ..... F17C 3/10

[58] Field of Search ..... 61/.5, 36 A; 62/45, 62/238, 260; 165/45; 220/9 LG, 9 B

[56] References Cited

UNITED STATES PATENTS

| | | | |
|---|---|---|---|
| 1,119,011 | 12/1914 | Grosenor | 62/238 X |
| 1,587,984 | 6/1926 | Pearce | 61/36 A |
| 2,332,227 | 10/1943 | Jackson | 61/36 A X |
| 3,047,184 | 7/1962 | Van Bergen et al. | 220/18 |
| 3,076,317 | 2/1963 | La Fave | 61/.5 |
| 3,246,479 | 4/1966 | Kelley | 62/45 |
| 3,848,418 | 11/1974 | Takase et al. | 220/9 LG |
| 3,848,427 | 11/1974 | Loofbourow | 62/260 |

*Primary Examiner*—William F. O'Dea
*Assistant Examiner*—Ronald C. Capossela
*Attorney, Agent, or Firm*—Norris & Bateman

[57] ABSTRACT

A cryogenic storage tank characterised by the provision of a space between the outer walls of the tank and the ground surrounding same, and means for introducing heated air into said space at the lower regions thereof for flow upwardly therethrough.

12 Claims, 1 Drawing Figure

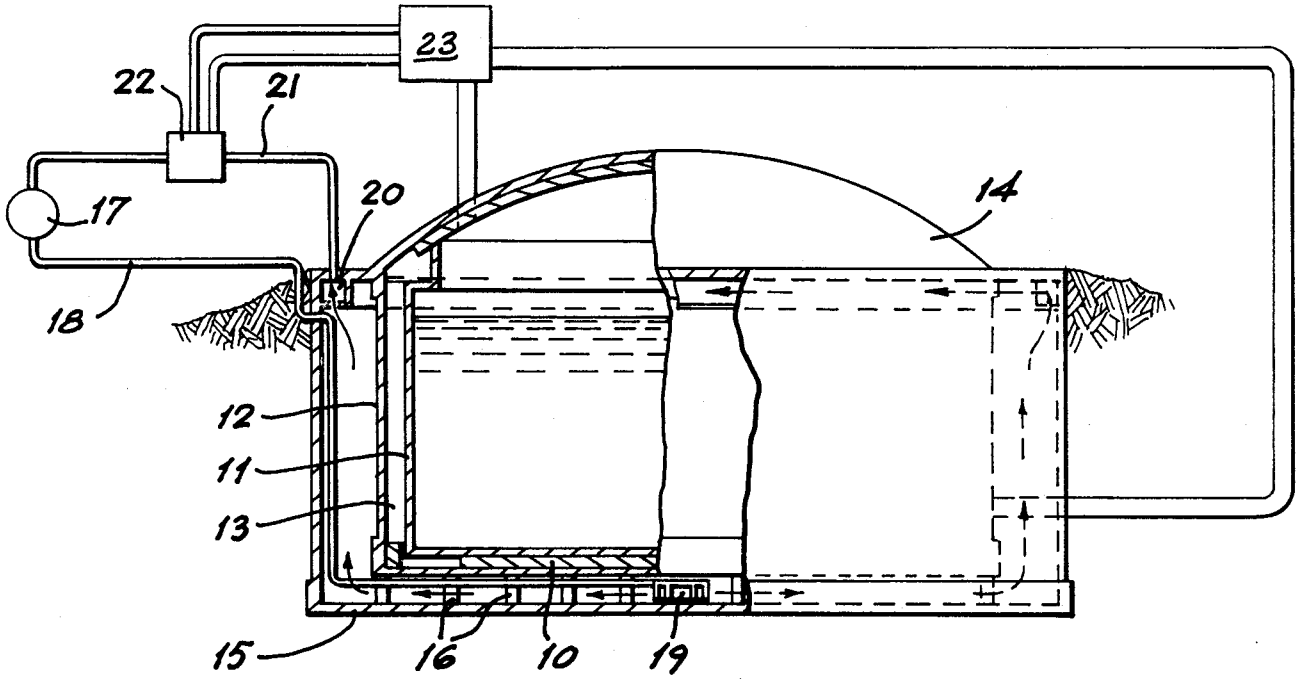
14
23
20
21
22
17
18
12
11
13
15
16
10
19

CRYOGENIC STORAGE TANKS

This invention concerns cryogenic storage tanks for the storage of low temperature liquids, such as liquefied petroleum gas or liquefied natural gas for example, at or about atmospheric pressure, and which are at least partially buried in the ground.

Such tanks, although heavily insulated, nevertheless draw some heat from their surroundings. It is important that the thermal gradients within the ground in which the tank is buried are not disturbed or ground movement can occur. If the ground cools to a point where large scale ice formation occurs ground heave can lead to destruction of the tanks which is both hazardous and costly. It is therefore known to provide electric cables for heating a layer of sand or other suitable material disposed between the tanks and the ground surrounding same to ensure that any heat passing into the tanks is supplied independently and not taken from the ground itself.

The provision of such electric cables has certain disadvantages. The kind of heat required to be generated over unit area of the outer wall of the tank is small and the heating wires themselves are therefore frail and require heavy insulation. This is wasteful in material and the cost of the system is consequently high. More importantly, once the system has been insulated it is difficult or impossible to adjust the heat distribution pattern and of course the wiring becomes inaccessible for maintenance requiring its duplication as a precaution against total failure.

It will be understood that the temperature of the ground increases with depth into the ground and therefore more heating should be supplied around the base regions of the tank than the upper regions, of the tank if the thermal gradients within the ground are to remain undisturbed, the rate of flow of heat into the tank being dependent upon the temperature difference across the wall of the tank. The present invention is based upon an appreciation of the possibility of providing heat around the tank by simple means which achieve the theoretical requirement mentioned above.

Thus according to the present invention a cryogenic storage tank is characterised by the provision of a space between the outer walls of the tank and the ground surrounding same, and means for introducing heated air into said space at the lower regions thereof for flow upwardly therethrough.

The invention will be further apparent from the following description with reference to the single FIGURE of the accompanying drawing which shows, by way of example only, a partially sectioned view of one form of cryogenic storage tank embodying the invention.

Referring now to the drawing, it will be seen that the cryogenic storage tank is essentially comprised by an insulating circular base generally indicated at 10, a cylindrical side wall comprised by inner and outer skins 11 and 12 respectively, defining a cavity 13 therebetween which is filled with an insulating material, and a domed roof generally indicated at 14.

As clearly seen from the drawing, the tank is essentially buried below ground level, only the domed roof 14 protruding above the ground.

In accordance with the invention the tank is located in a recess in the ground whose sides and base are conveniently lined with a concrete or similar wall 15 such that there is an annular space between the outer skin 12 of the tank and the wall 15, and a space providing a free passage for the flow of air beneath the base 10 of the tank, the base 10 of the tank being supported by structural members 16 for this purpose.

Heated air is supplied by means of a blower 17 through a duct 18 which connects with an air distribution manifold 19 located beneath the base 10 of the tank at the centre thereof. The air is discharged from the manifold 19 for outward and radial flow therefrom beneath the base 10 of the tank and thence upwardly through the annular space between the wall 15 and outer skin 12 for collection into an annular main 20 extending around the tank towards the upper end thereof.

The air collected in the main 20 is re-cycled to the blower 17 by a duct 21 via a heating means 22. The heating means 22 may be comprised, for example, by an electrical resistance heater or preferably by a heat exchanger whose primary heat source is derived from waste heat from the compressor 23 necessary to maintain the contents of the tank liquid, it being understood that vapours which boil off from the liquid in the tank are collected and passed through the compressor to be re-liquefied for return to the tank.

It will be appreciated that with the arrangement described any heat which leaks inwardly to the interior of the tank through the insulation thereof is derived from the warm air which is circulated around the outside of the tank and that the ground in which the tank is located is not cooled.

It will be appreciated that it is not intended to limit the invention to the above example only, many variations such as might readily occur to one skilled in the art, being possible without departing from the scope thereof.

What is claimed is:

1. An at least partially subterranean cryogenic storage tank for the storage of low temperature liquids characterised by the provision of means defining an enclosed fluid conductive space between the bottom and side walls of the tank and the adjacent ground below ground level, and means for continually introducing heated air into said space at the lower regions thereof for heat exchange flow therethrough along said bottom wall and upwardly along said side wall.

2. A cryogenic storage tank according to claim 1 wherein the tank is located in a recess in the ground, the sides and base of the recess being provided with a lining to define a fluid conductive space surrounding the side wall of the tank and beneath the base thereof, the tank being supported on suitable structural members in said space.

3. A cryogenic storage tank according to claim 2 wherein a blower is provided and adapted to pass heated air through a duct to a distribution manifold located in said space beneath the base of the tank at the centre thereof, the air being discharged from the manifold for outward flow beneath the base of the tank and upward flow around the sides of the tank.

4. A cryogenic storage tank according to claim 3 including air heating means comprising a heat exchanger whose primary heat source is derived from waste heat from a compressor used to maintain the contents of the tank liquid.

5. A cryogenic storage tank according to claim 2 including air heating means comprising a heat exchanger whose primary heat source is derived from waste heat from a compressor used to maintain the contents of the tank liquid.

6. A cryogenic storage tank according to claim 1 wherein a blower is provided and adapted to pass heated air through a duct to a distribution manifold located in said space beneath the base of the tank at the centre thereof, the air being discharged from the manifold for outward flow beneath the base of the tank and upward flow around the sides of the tank.

7. A cryogenic storage tank according to claim 6 including a manifold surrounding the tank at the upper end thereof to collect the air passing upwardly through said space for re-cycling to said blower via heating means.

8. A cryogenic storage tank according to claim 7 including air heating means comprising a heat exchanger whose primary heat source is derived from waste heat from a compressor used to maintain the contents of the tank liquid.

9. A cryogenic storage tank according to claim 3 including a manifold surrounding the tank at the upper end thereof to collect the air passing upwardly through said space for re-cycling to said blower via heating means.

10. A cryogenic storage tank according to claim 9 including air heating means comprising a heat exchanger whose primary heat source is derived from waste heat from a compressor used to maintain the contents of the tank liquid.

11. A cryogenic storage tank according to claim 3 including air heating means a comprising a heat exchanger whose primary heat source is derived from waste heat from a compressor used to maintain the contents of the tank liquid.

12. A cryogenic storage tank according to claim 1 including air heating means comprising a heat exchanger whose primary heat source is derived from waste heat from a compressor used to maintain the contents of the tank liquid.

* * * * *

UNITED STATES PATENT OFFICE

CERTIFICATE OF CORRECTION

PATENT NO. : 3,952,531

DATED : April 27, 1976

INVENTOR(S) : Frederick Henry Turner

It is certified that error appears in the above-identified patent and that said Letters Patent are hereby corrected as shown below:

In the Priority Data, change "4923/73" to --4925/73--.

Signed and Sealed this

Fifteenth Day of March 1977

[SEAL]

*Attest:*

RUTH C. MASON
*Attesting Officer*

C. MARSHALL DANN
*Commissioner of Patents and Trademarks*